US010201470B2

(12) United States Patent
Griner

(10) Patent No.: US 10,201,470 B2
(45) Date of Patent: Feb. 12, 2019

(54) DEVICE FOR DELIVERY OF RESONANT FREQUENCIES TO TREATED MUSCLES

(71) Applicant: HEALTHY MUSCLES LLC, Los Angeles, CA (US)

(72) Inventor: Thomas Edward Griner, Los Angeles, CA (US)

(73) Assignee: Healthy Muscles LLC, Los Angeles, CA (US)

( * ) Notice: Subject to any disclaimer, the term of this patent is extended or adjusted under 35 U.S.C. 154(b) by 661 days.

(21) Appl. No.: 14/963,146

(22) Filed: Dec. 8, 2015

(65) Prior Publication Data

US 2017/0156974 A1 Jun. 8, 2017

(51) Int. Cl.
*A61H 23/02* (2006.01)
*A61H 23/00* (2006.01)

(52) U.S. Cl.
CPC ... *A61H 23/006* (2013.01); *A61H 2201/1215* (2013.01); *A61H 2201/1418* (2013.01); *A61H 2201/1664* (2013.01)

(58) Field of Classification Search
CPC ..... A61H 23/006; A61H 2201/1664; A61H 2201/1215; A61H 2201/1418; A61H 23/0254; A61H 2201/0153; A61H 2201/0157; A61H 2201/149; A61H 2201/501; A61H 2201/5097
See application file for complete search history.

(56) References Cited

U.S. PATENT DOCUMENTS 4,513,737 A * 4/1985 Mabuchi ..... A61H 23/0254 601/101
4,827,914 A * 5/1989 Kamazawa ..... A61H 23/0254 601/101
4,841,955 A * 6/1989 Evans ..... A61H 23/0218 601/101
5,088,474 A * 2/1992 Mabuchi ..... A61H 7/001 601/110
5,140,979 A * 8/1992 Nakagawa ..... A61H 23/0218 128/907
5,951,501 A 9/1999 Griner
6,228,042 B1 * 5/2001 Dungan ..... A61H 1/008 601/101
6,537,236 B2 * 3/2003 Tucek ..... A61H 1/008 601/101

(Continued)

*Primary Examiner* — Steven O Douglas
(74) *Attorney, Agent, or Firm* — SoCal IP Law Group LLP; Steven C. Sereboff

(57) ABSTRACT

A drumming device for delivering a repetitive percussive strike to muscles below a skin surface comprises a main housing enclosing an electric motor with a shaft having a fixed rotational speed, a drive pulley, a toothed belt encircling the drive pulley and a driven pulley with an integral cam mounted on the pulley such that the rotating shaft causes the driven pulley to rotate at a predetermined number of cycles per second, the assembly causing a repetitive, reciprocal movement of a plunger body a fixed distance and at 16.6 cycles/sec, the plunger movable in a downward direction following contact with the cam, such that the plunger reciprocates within the housing when the cam member contacts the plunger causing the plunger shaft to move laterally outward. When the massaging device is properly position in contact with the skin the moving plunger causes muscle spindles to vibrate at their resonant frequency.

10 Claims, 9 Drawing Sheets

(56) References Cited

U.S. PATENT DOCUMENTS

| | | | | |
|---|---|---|---|---|
| 6,723,060 | B2 * | 4/2004 | Miller | A61H 23/02 601/101 |
| 7,144,417 | B2 * | 12/2006 | Colloca | A61H 1/008 606/239 |
| 8,083,699 | B2 * | 12/2011 | Colloca | A61H 1/008 601/101 |
| 8,096,963 | B2 * | 1/2012 | Murugan | A61H 1/008 601/107 |
| 9,889,066 | B2 * | 2/2018 | Danby | A61H 23/0254 |

* cited by examiner

DEVICE FOR DELIVERY OF RESONANT FREQUENCIES TO TREATED MUSCLES

FIELD OF THE INVENTION

The invention relates to pulsating devices, more particularly to pulsating devices capable of placing muscles in resonant vibration and stimulating muscle spindles.

DESCRIPTION OF THE PRIOR ART

Many people suffer from various ailments, such as allergies, headaches, arthritis, asthma, high blood pressure, or digestive disorders as well as constant pain from these ailments including but not limited to backaches, knee problems, and Temporomandibular Joint Syndrome.

Thomas Griner, in "What's Really Wrong With You?, published by Avery Publishing Group, incorporated herein in its entirety by reference, presents an analysis of how muscles can affect your health and how unhealthy muscles can cause a broad range of disorders, from back pain to bronchitis. Many common ailments and how they can be corrected are addressed by Griner. He discusses how muscles become unhealthy, shows the physiological role of muscle in many illnesses, and explains body-friendly exercises and muscle-massaging techniques to address various ailments. One technique is to deliver concentrated, very short and very fast controlled tapping of the muscle (percussion). There is a fraction-of-a-second delay in the stretch-reflex response, so considerably more pressure can be delivered with percussing than with stroking, allowing massage of deep tissues that one could not otherwise reach to be worked on. Such percussive technique cannot be properly applied manually. Accordingly, Griner developed a percussive device for use in this mechanical massage procedure, described and claimed in U.S. Pat. No. 5,951,501, incorporated herein in its entirety by reference. The device described therein as a massage device delivers percussion forces faster than can be delivered manually, and as a result can generate strong biological nerve responses.

Other prior art massagers, even those with a percussive movement, each thrust takes too long, and there are too many thrusts per second. This overloads the nerve circuits and produces a jumbled, tingling response which does nothing to relieve muscle spasms.

FIGS. 2A-2D schematically illustrate the movement of various prior art devices, described below. In each instance a plunger movement of about ¼ inch is generated no more than about 15 times per second.

The Basic Vibrator—Vibrators, such as shown in FIG. 2A, for which there are numerous different designs, have been marketed for various different body contacting applications, one of which is pain relief. These devices provide an active portion 80 that provides vibrating motion delivered by pure oscillation, generally from an of-center drive in parallel or perpendicular strokes, or combinations thereof, to the skin 103, depending on how the vibrator is held. A typical function curve is illustrated by a sine wave 1/15 of a second per cycle. The curve shows a typically initial movement such as a forward or downward movement, referred to as a "punch", of a treatment tip occurring at about 30° in the cycle (A) and a reversal of the movement (B), referred to as a "pulled punch", starting at about 150° in the cycle. These devices can trigger endorphin release but they are not capable of relaxing the muscles adjacent to the vibrating tip because they do not incorporate a "quiet time". An additional deficiency of these devices is the applicator vibration motion delivered by a vibrating tip is accelerated very slowly such that maximum velocity is not reached until one-fourth (90°) of a movement cycle of the tip. While the initial low velocity is high enough to compress the tissues, the motion then begins slowing down so that any attempt at a percussive snap is thwarted. As a result, this device is only capable of displacing tissues in a jiggling movement 101 (see FIG. 5) and cannot generate a resonant vibration in the muscle to which it is applied. Such vibrators only trigger static stretch reflex contractions.

The Seesaw Paddle-Thumper Types—These devices 82, which allow only motion perpendicular to the skin, also produce an oscillatory motion and thus suffer the same deficiencies as the vibrator. The motion profile shown in FIG. 2B, is for an applicator with two spheres on the end of a seesaw paddle attached to a crank drive. A first sphere is 180 degrees out of sync with a second sphere. If both spheres are touching the same long muscle, that muscle is being jiggled about 30 times per second. These devices are represented as being percussion devices simply because they only move perpendicular to the skin 103; however oscillatory motion is not percussive. The curve has a steeper slope but typically the same characteristics as generated by the vibrator of FIG. 2A.

Gradual Acceleration Percussor-Solenoid Driven Devices—These devices, as represented in FIG. 2C, differ from the devices discussed in regard to FIGS. 2A and 2B above in that the motion profile is generated mainly by electrical parameters instead of mechanical assemblies. They utilize a special power supply to control the pulse frequency. These types of devices have internal limitations on the maximum velocity that can be achieved because they use a solid iron armature (piston) 84 which provides a piston action as it moves within the a solenoid coil 86 and stops (collides) at the end of each stroke. The force of this collision must be controlled to not exceed the elastic limits of the armature 84, or permanent deformation will occur. Because the amount of force contained in a moving mass increases by the square of its velocity the maximum velocity is limited to 19.6 in/sec.

Once the piston motion has reached maximum depth within the solenoid, its movement stops and the heavy piston must then be accelerated in the opposite direction. This causes a slight delay (dwell time) at the bottom of each stroke. Such a dwell squelches any resonant frequency vibration that may be triggered. As a result, this device has a quiet time of 0.049 seconds when operated at 15 strokes per second. This is less than the minimum of 0.059 seconds which is necessary to activating a static stretch reflex contraction in the muscle. Again, this does not create the desired resonant muscle response by does generate endorphin release.

Impact Percussor (Biopulser®)—FIG. 2D is a schematic representation of a device utilizing the teachings of U.S. Pat. No. 5,951,501, issued Sep. 14, 1999 to Thomas Griner, which shows a rapid stroke cycle with a long dwell of 0.059 sec between strokes provided by a cam extending from a rotating timing belt 88 to provide a pulsating muscle massaging device. The impact of the cam in this device accelerates a lightweight plunger mechanism to full velocity almost instantaneously. This provides an average velocity that is more than three times greater than the solenoid device, yet does not trigger a pain reflex contraction. The motion profile shows a maximum velocity which is just less than the maximum allowable 70 in/sec necessary to trigger a pain reflex contraction.

The device described in the '501 patent provides fewer thrusts per second, each thrust being of extremely short duration in a manner compatible with the biological recovery period of the nerve circuits, allowing the nervous system to integrate the stimulation. This device provides a massaging action to the muscles to which it is applied. However, it has been discovered that the muscle response to such a device can be improved and, by changing the percussive parameters and the method of delivering the percussion action, unexpected and significantly enhanced muscle and tissue response can be elicited. While the '501 device provides a desirable massaging function it is not capable of stimulating the muscle spindle.

SUMMARY

It is an object of the disclosed device described and shown herein to provide an improved pulsating muscle and membrane massaging device which percusses quickly with very short strokes to a controlled, predetermined depth by providing a "drumming" action. This is preferably accomplished by providing a device having motor activated cam on a pulley wheel adapted to drive a skin contacting plunger having a resilient skin contacting tip with a physiologically beneficial stroke cycle and a defined stroke length, the percussive force being transmitted to the muscle and tissue so that the muscle and surrounding membrane are "drummed" into their resonant vibration frequencies, which is a function of the tension exhibited by the muscle. The specific form and frequency of the drumming also provides stimulation to the muscle spindles.

DETAILED DESCRIPTION

The prior device, which was covered by U.S. Pat. No. 5,951,501 (the '501 patent, was designed to massage muscles but did not effectively stimulate nerve organs (muscle spindles) imbedded deep in the muscle tissue. The muscle spindles, which detect the degree of muscle contraction, are sensory receptors existing throughout all skeletal muscles. The muscle spindles excite the anterior motor neurons by transmitting impulses almost continuously through the posterior roots into the spinal cord. This excitation in turn provides necessary nerve stimuli for muscle tone. Skeletal muscle tone is a result of nerve impulses coming from the spinal cord. These impulses are controlled by impulses transmitted from the brain to appropriate anterior motor neurons as well as impulses that originate in muscle spindles located within the muscle. Summation of twitches of many fibers, excited asynchronously at frequencies up to 5/sec., (a low frequency) generates a fairly steady total force with an amplitude approximately proportional to the average frequency of excitation. The "background" tension produced by summation of the fiber twitches is called "tone". All the muscles in a living organism have tone. Even when a portion of the body is relaxed the motor nerves therein are activated at a low frequency. The resulting tone is detectable as a resistance to movement of that body portion, such as bending of a limb. Normal tone (a naturally occurring, biological base line) is maintained in each muscle unit so as to provide a total muscle tone. This normal total muscle tone is the degree of contraction exhibited by a normal resting muscle, which has no slack to be taken up when action occurs, and maintains the proper anatomical attachment relationships. While the muscle may be resting, it is, in any event, functioning as intended.

Figure 5:
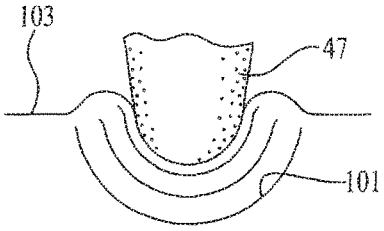
FIG. 5 PRIOR ART
FIG. 5 is an illustration of massaging a muscle using a prior art device such as illustrated in FIGS. 2A-C.
Figure 6:
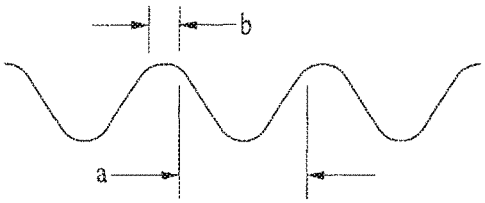
FIG. 6 PRIOR ART
FIG. 6 is a graphic illustration of the of the tip movement of the prior art technique in FIGS. 2A-C.

A term that may be used to describe the function of the Biopulser is a "dehypertoniator" and its operation can be related to the functioning of a defibrillator. A defibrillator does not have to access the central nervous system. The "normal" pace of the heart beating is controlled in the sino-auricular node on the heart itself. In a heart attack situation, the voltage pulse from the paddles of a defibrillator blocks all neural activity in the heart, which in turn allows the node, which is able to recover normal function, to regain control. The "normal" settings for muscle tone is located in the cerebellum thus requiring accessing the central nervous system via feedback nerves from the muscle spindles. While vigorous stimulation provided by the resonant frequency vibration nerve generators described herein does not block neural activity they over-stimulate the nerves. This produces a "white noise" signal with overrides the existing faulty nerve feedback signals. This results in the cerebellar control center to return the nerves to their normal setting. This in turn reduces the excess tone of the section of the muscle which was responsible for the malfunction of the feedback generators. Hypertonicity is the result of a vicious cycle that can be disrupted in this manner The device described in the '501 patent was designed to produce a deeply penetrating compression wave applied in a way (see FIGS. 5 and 6 herein) that would avoid affecting the biological sensors that cause a reactive muscle contraction. When the '501 patent was filed it had not yet been discovered that the muscles could be set into resonant vibration. That device was not designed to, nor did it have the capability of, establishing resonant vibrations in the muscle or membranes. Various attempts have been made to modify and optimize the device described in the '501 patent. While these modifications, described below, were extensive they failed to provide the desired capabilities and physiological benefits of the new device described herein, referred to as the BioPulser 2, which included, along with other mechanical changes, needle bearings, a single or double escapement, vibration dampers, a totally new cam arrangement and different operating parameters.

Figure 1:
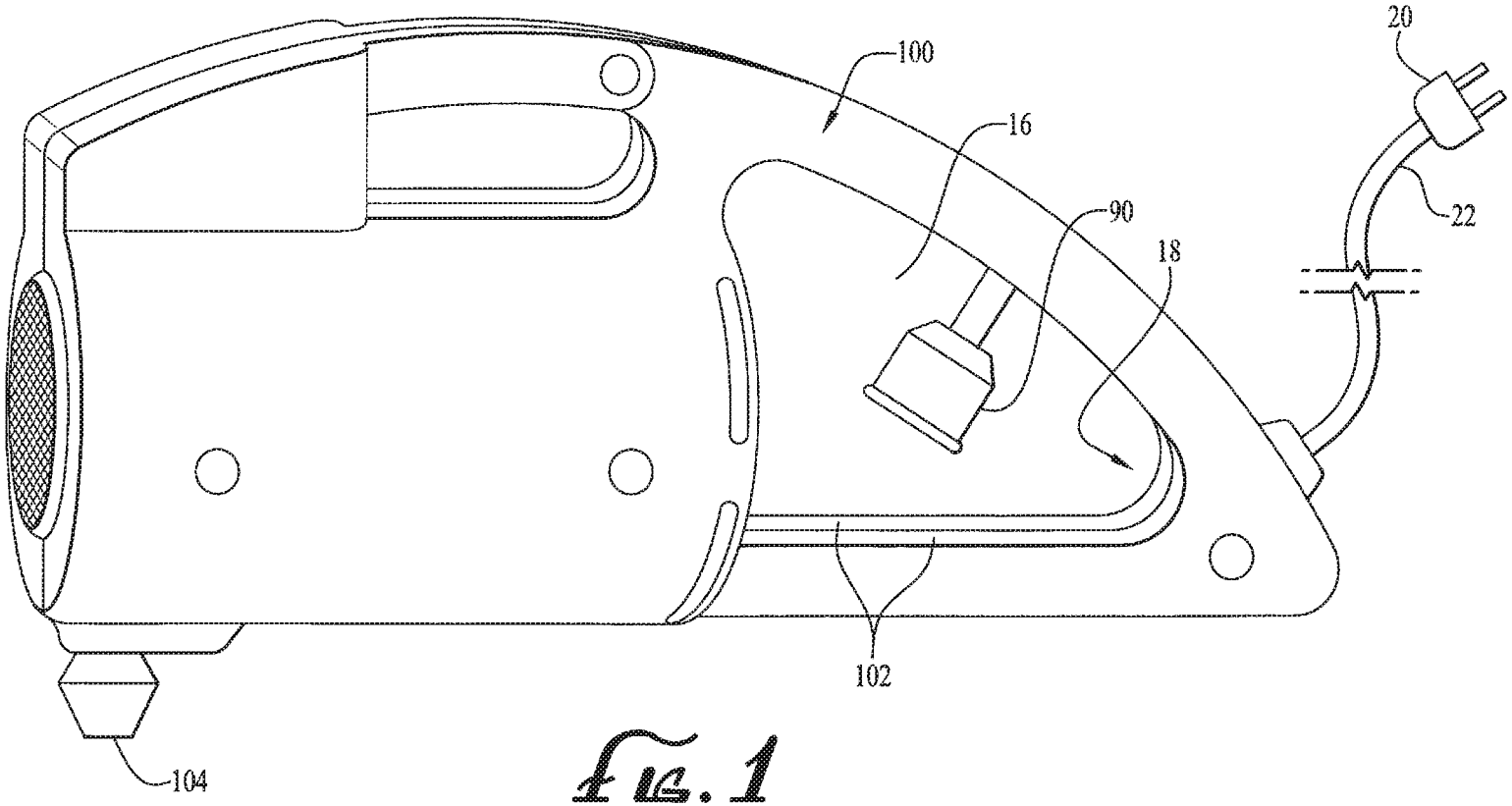
FIG. 1 is a perspective view of a percussive device incorporating features of the invention as described herein.
Figure 2A:
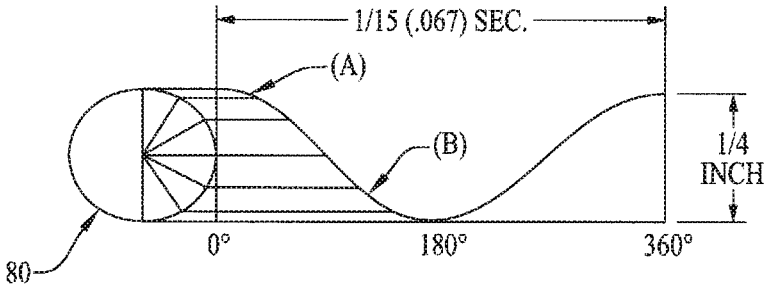
FIG. 2A PRIOR ART
FIGS. 2A-2D are schematic representations of prior art devices showing a single 360° cycle indicating the movement of a functional element.
Figure 2B:
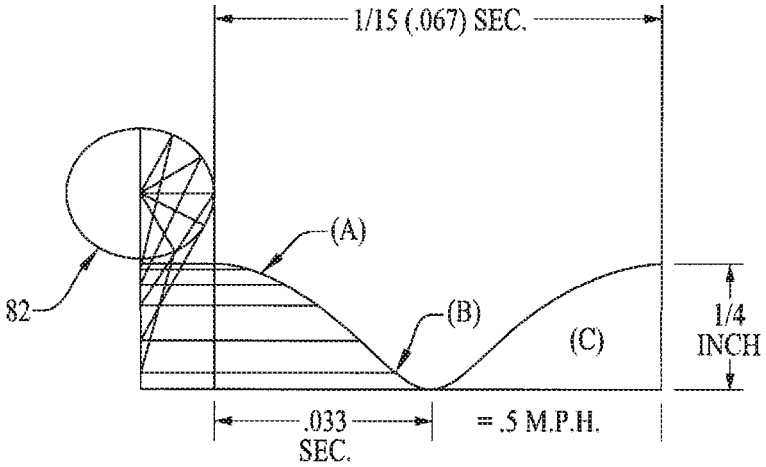
FIG. 2B PRIOR ART
Figure 2C:
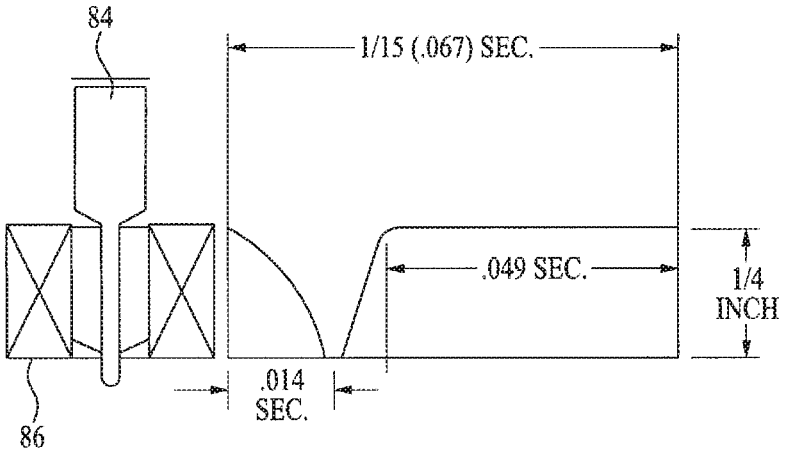
FIG. 2C PRIOR ART
Figure 2D:
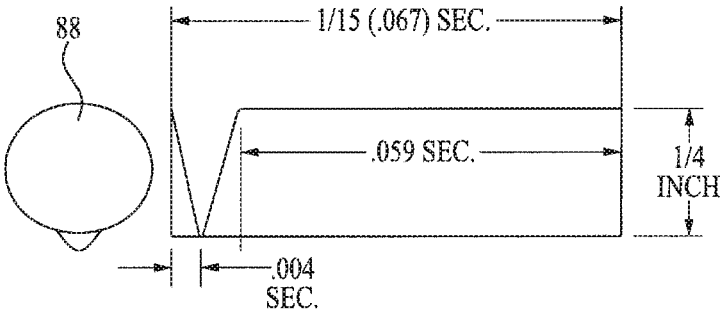
FIG. 2D PRIOR ART
Figure 3:
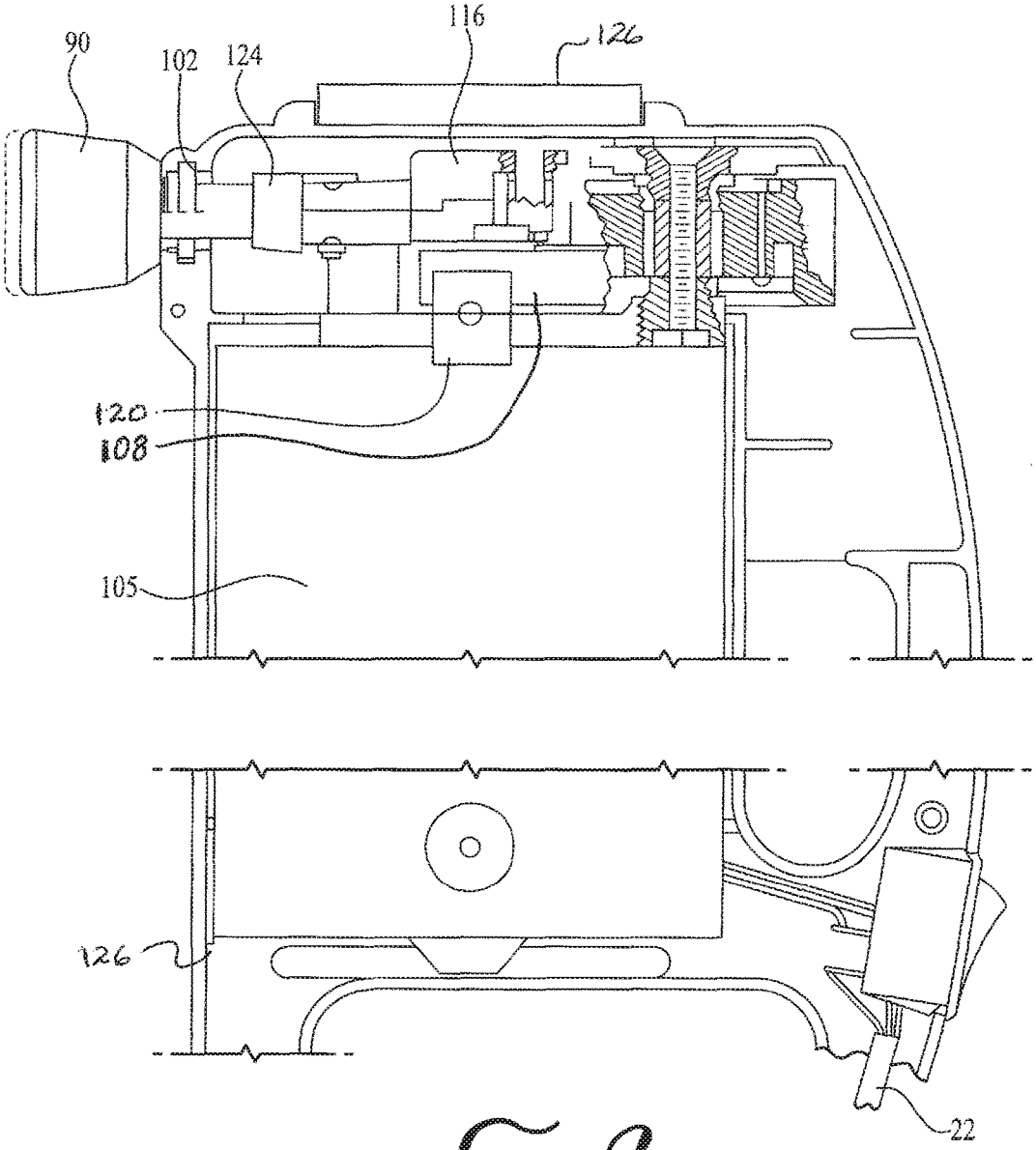
FIG. 3 is a cutaway side view of the internal moving parts of the device of FIG. 1.
Figure 4:
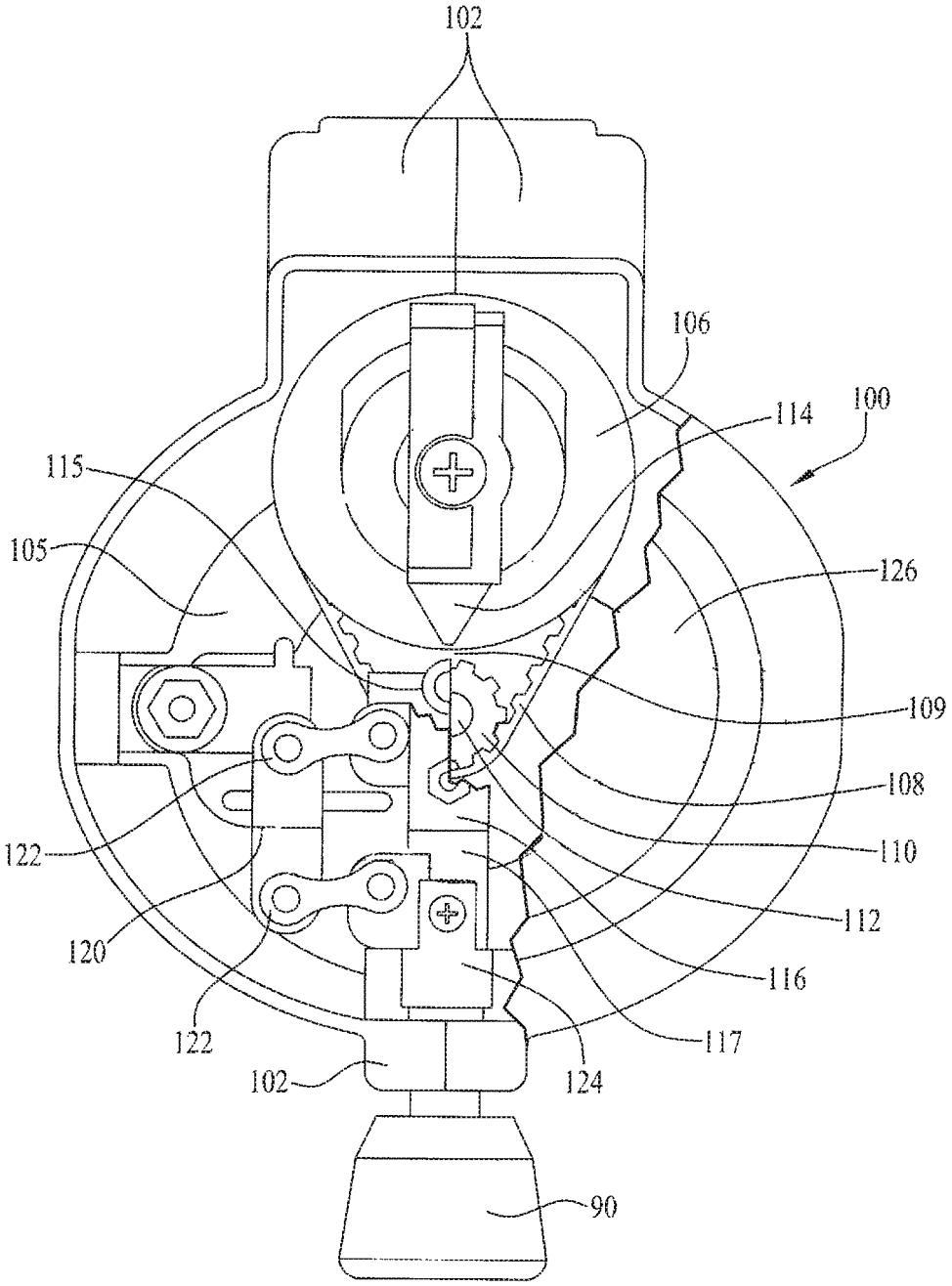
FIG. 4 is a partial cutaway front view of the internal moving parts of the device of FIG. 1.
Figure 10:
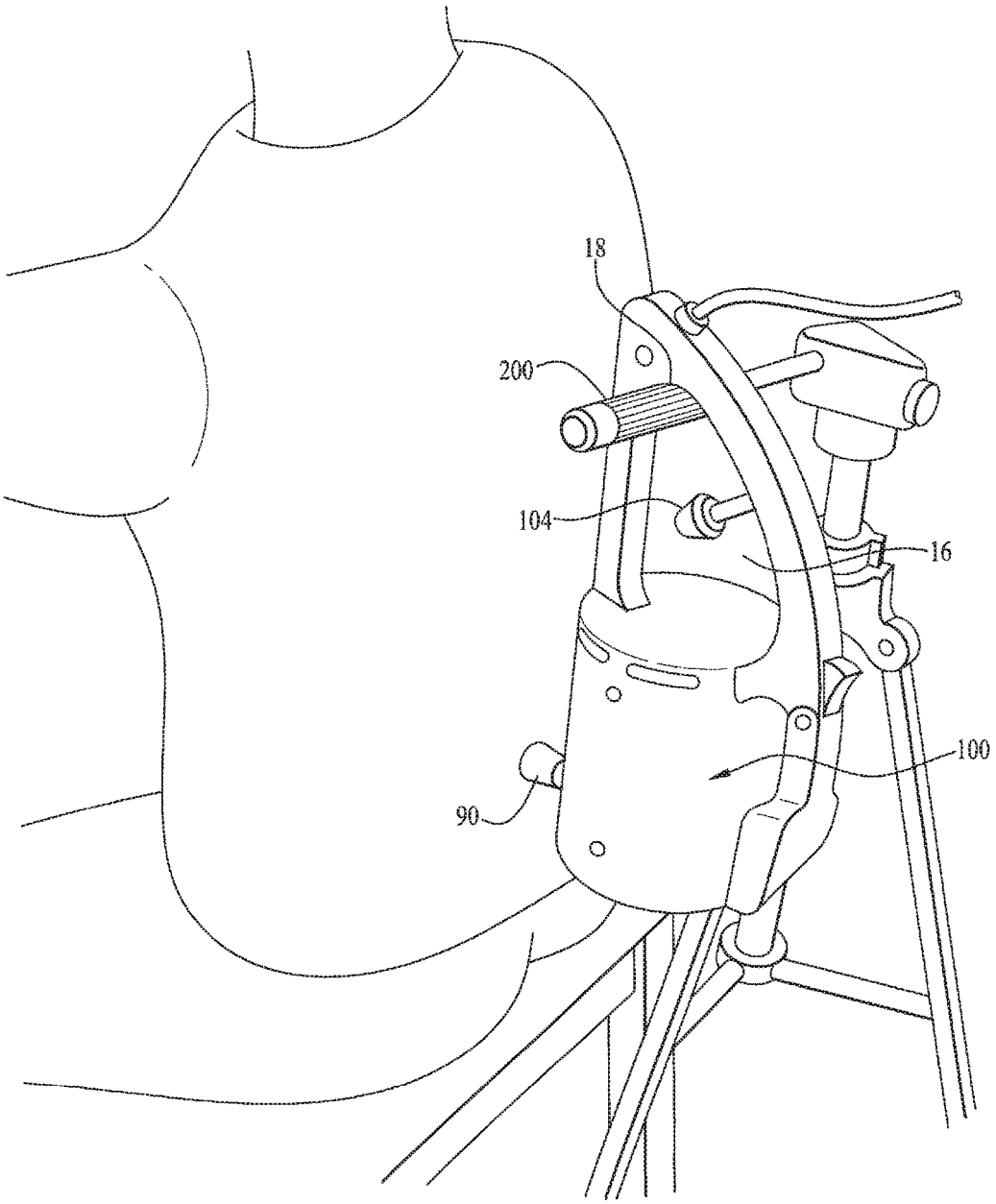
FIG. 10 shows a device incorporating feature of the invention suspended on a vertical stand.

FIG. 3 is a cutaway side view and FIG. 4 is a cutaway front view of the internal components of the new device 100 with the cover 102 removed to display the inner components. In use, an interchangeable applicator tip 90, 104, also referred to as a plunger tip, is gently placed resting against the skin surface 103 (see FIGS. 10 and 11) to deliver the "drumming" action as the applicator tip is repeated driven in and out of the case 102 by movement of the two piece plunger body 116. Various shaped applicator tips may be used, the shape thereof selected to best conform to the surface being treated. FIG. 1 shows a pointed or truncated cone shaped applicator tip 104 in an operative positions and a second flatter or bell shaped applicator tip 90 in a stored location. FIGS. 3, 4, 10 and 11 show the second applicator tip 90 in the operative position. The bell shaped tip 90 is a preferred tip as it is easier to "float" on a relatively flat overlying tissues. The truncated cone shaped tip 104 is more suitable for tight spaces such as use on jaw muscles where the flatter tip 90 cannot reach. FIG. 10 shows a person using the device 100 which incorporates features of the invention in an operative position to massage muscles. The plunger tip can be of any suitable material such as neoprene rubber. A 3000 RPM motor 105, best shown in FIG. 3) and partially hidden behind other components in FIG. 4, has a drive shaft 112 positioned in the center axis of the drive pulley 110, which causes the timing belt 108 to rotate, which in turn drives the cam pulley 106. Each time the cam pulley 106 rotates 360° the cam 114 strikes the cam follower 115 on the upper portion of the plunger body 116 and drives the plunger body 116 forward.

A three piece connector assembly maintains the plunger body 116 in its proper position and acts to guide the plunger body 116 as it extends, the resilient rubber bumper 124 strikes the case 102 and then bounces back and returns to its rest position following its cam driven movement downward. The three piece connector assembly comprises a base structure 120 secured to the device 100 frame and two moveable links 122 which connect the base structure 120 to the plunger body 116.

Activation of the motor 105 rotates the drive shaft 112 which is connected to the drive pulley 110 which drives the timing belt 108 and in turn rotates the cam pulley 106. During each rotation of the cam pulley 106 the cam 114 strikes the cam follower 115 on the upper portion of the plunger body 116 driving the plunger body downward so that a the rubber bumper 124 on a the lower portion of the plunger body strikes the case body 102. The size of the various moveable components are chosen so that the cam strike occurs 16.6 times/sec (i.e., 16.6 revolutions per second).

The operation of the device, and the escapement arrangements described below used in the improved device, requires that this device be held in a completely different manner (compare FIG. 1 of the '501 patent to FIGS. 10 and 11 of this application). See U.S. Pat. No. 5,951,501 incorporated herein in its entirety by reference. Specifically, it must be held loosely and dangled by supporting only the inside radius at the tail end of the handle. That radius is located at a null point from the center of gravity of the device.

The operation of the BioPulser 2 shown herein causes the muscle to be placed in its tensioned resonant vibration and adds the capability of muscle membrane vibration and muscle spindle activation to the massage procedure. The fact that muscle membranes could also be triggered into vibrating at their resonant frequencies in vivo and the muscle spindle activated is a new capability not previously available, which resulted from the total redesign of the moving components previously present in the '501 patent.

Figure 12:
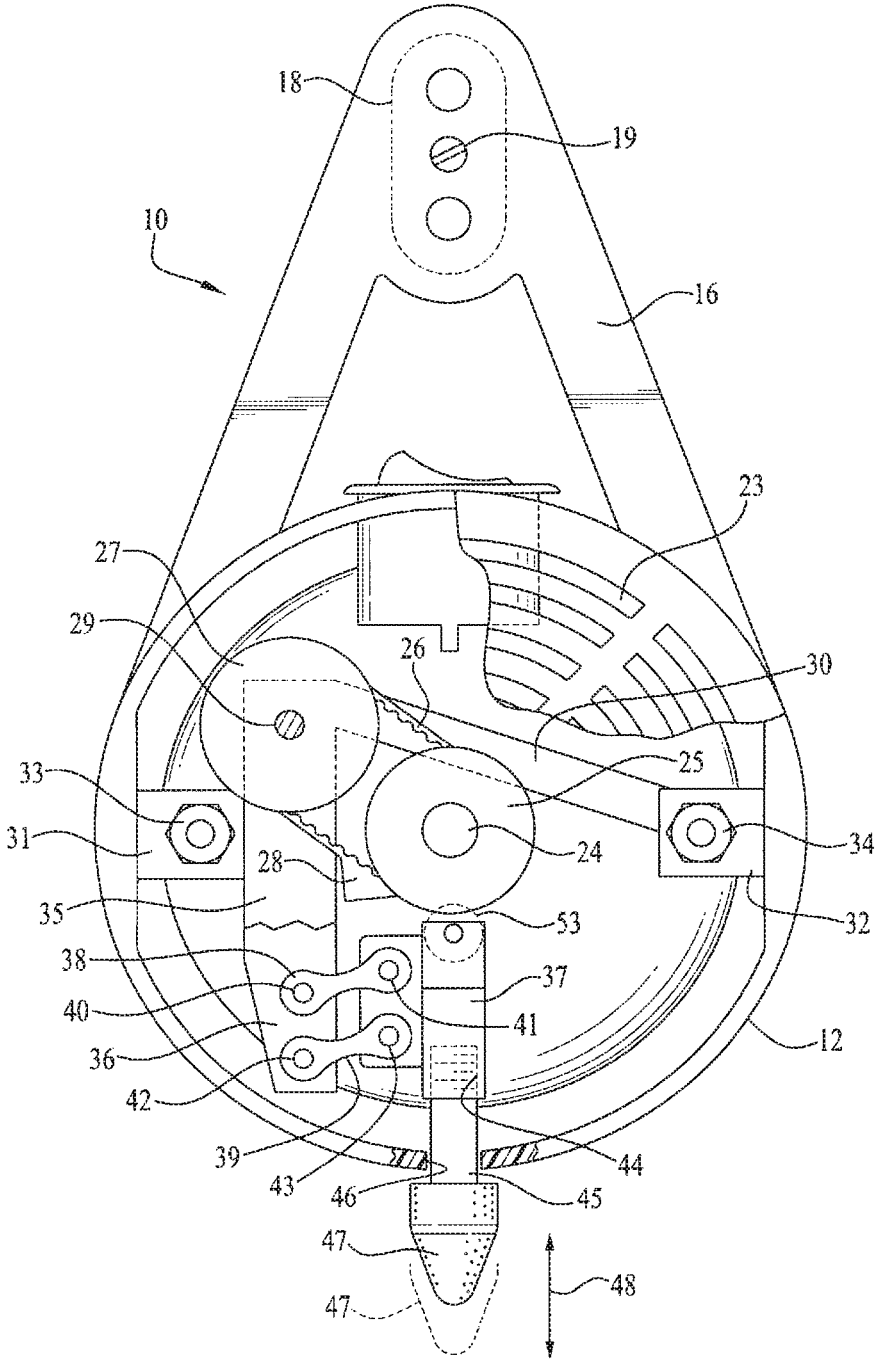
FIG. 12 PRIOR ART
FIG. 12 is a reproduction of FIG. 3 of U.S. Pat. No. 5,951,501, incorporated herein by reference provided for comparative purposes.

It was found that prolonged usage of the 1500 R.P.M. motor embodiment of a device assembled in accordance with the teachings of the '501 patent caused over-heating of the unit. Therefore, with reference to FIG. 3 of the '501 patent, also included herein as FIG. 12, the prior 1500 RPM motor was first replaced by a 3000 R.P.M. slip-sync induction motor to provide faster cooling fan speed. With reference to the '501 patent, this in turn required that the drive pulley 25 be reduced from a 12 tooth pulley to a pulley with 10 teeth and the toothed belt 26 was increased from 23 teeth to 33 teeth. This caused the ramp 28 on the toothed belt 26, which interacted with the bearing 53 and in turn activate the plunger body 37, to drive the plunger body forward 15.1 times per second. The smaller drive pulley also resulted in the movement of tip of the ramp 28 following a smaller diameter (1.18 inch compared to 1.32 inch) while doubling the angular velocity. This resulted in the ramp 28 tip having a circumferential velocity about 1.8 times that of the 1500 RPM prior art embodiment. A second idler pulley then had to be added to support the longer belt. Also, due to the higher speed, the bronze bearings used in the 1500 RPM embodiment had to be changed to ball bearings, and subsequently to needle bearings. In turn, this faster device required that the maximum piston 45 stroke length be limited to 0.120 inches, which resulted in the time to complete a maximum stroke being reduced to less than ½ of the time previously required.

It was discovered that when the prior art 1500 RPM unit was replaced by a 3000 RPM motor and the other changes to the prior Biopulser were made and the modified device was positioned to provide only a very light contact with the skin surface 103 occasionally, but not consistently, the percussion would result in the muscle being triggered into its resonant frequency vibration. This occasional vibration did not occur when the 1500 R.P.M. drive with the prior internal configuration, prior components and the longer stroke length were used. Accordingly, it was concluded that the internal components in the massage device as taught by the '501 patent were incapable of triggering resonant frequencies and the prior art device, even if modified as discussed below could not consistently and continuously trigger resonant frequencies. Accordingly, the device had to be completely redesigned and the internal mechanisms reengineering in order to provide the ability to consistently and continuously place the muscle in its resonant frequency. This further necessitated a new two-piece enclosure with a trailing handle, as discussed below, which made it possible to hold the device in a different way that provided longer and stronger induced resonant vibrations.

Figure 9:
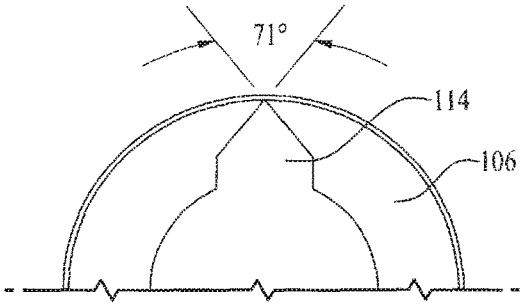
FIG. 9 is an enlarged view of a portion of the cam in the device as shown in FIGS. 1 and 4.

Still further, because the impact level provided by the improved device could not be sustained by the prior cam structure, specifically the urethane cam 28 as shown in the '501 patent, the ramp belt configuration was replaced by a solid cam pulley 106 which was further modified to enhance induced tissue vibration instead of creating tissue compression. The use of a solid cam pulley 106 also required a change from the drive pulley 25 and idler pulley 27 configuration of the '501 patent by a combination of a drive pulley 110 and cam pulley 106 as shown in FIGS. 4 and 9. The cam pulley 106 was in turn sized so the circumferential velocity of the cam tip on the cam pulley 106 was the same as that of the improved prior art driven cammed belt when the cam 28 was riding on the driven pulley 25. To accomplish this, the tip of the cam 114 was modified to rotate in a wider circle (see FIG. 9) with a diameter of 2.00 inches instead of 1.18 inch. In addition, a shorter maximum stroke (0.120 inch compared to 0.250 inch) was obtained allowing the percussion repetition rate to be increased 10% from 15.1 per second to 16.6 per second. This also increased the circumferential tip velocity. The cam profile (FIG. 9 herein) was also dimensioned differently from that shown in FIG. 9 of the '501 patent. The case enclosure was also dimensioned to limit the unextended and extended length of the plunger 104. The drive pulley 110 in the new device 100 has a 10 teeth, with a 30 tooth driven pulley 106; the timing belt 108 has 35 teeth. As pointed out above, the belt 108 no longer has a cam extension.

Figure 8:
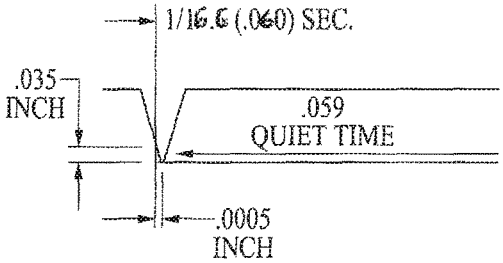
FIG. 8 is a graphic illustration of the tip motion profile obtained using the device of FIG. 7.

With reference to FIGS. 3 and 4, the new and improved device, the BioPulser 2, now incorporates a 3000 R.P.M. motor 105 that has less torque than the 1500 RPM motor while the drive shaft 112 has nearly 4 times as much angular inertia. Under heavy momentary load, the drive shaft 112 will instantaneously slip to a lower speed with the lost inertia being converted into torque. The longer dwell (quiet) time (see FIG. 8) allows the rotor to recover its rotational velocity which, at the same time allows for biological recovery of the treated muscle and membrane. Because the inertial pounding causes unusual torque loading in the drive shaft, and can eventually result in the drive shaft breaking, the motor was also modified by replacing the standard 0.250 inch diameter shaft with a 0.375 inch diameter shaft 112. As these inertial shocks can also result in the fan blade separating from standard aluminum hub, the aluminum hub was replaced with steel hubs. In addition, because the inertial pounding was discovered to cause the ball bearings to fail, they were replaced by needle bearings.

As a further improvement the cam/plunger interaction was modified in order to provide the plunger forward movement with a "free flight" space 109 (see FIG. 4). This free flight allows the plunger to instantaneously rebound from the skin surface 103, thus escaping from the surface before the contact of the plunger with the surface can squelch the muscle/membrane vibration that was triggered. This allows a higher plunger velocity and a more rapid escape from the surface which dramatically increases the amplitude of the induced vibration. Utilizing this technique the BioPulser 2 attains higher plunger velocity. The cam drives the plunger forward about 0.120 inch at which point the plunger is free to move forward (free flight) about an additional 0.035 inch (referred to as a "single escapement" configuration) at which point it strikes the skin surface 103 over the muscle and/or surrounding membrane. As a further improvement to this "free flight" configuration, the BioPulser 2 can alternatively include a rebounding mechanism, such as the rubber bumper 124 providing a "double escapement" to allow rapid repetition of the plunger strike against the muscle and membrane, the rubber bumper 124 also serving as a vibration damper. In a preferred embodiment, the device has a plunger frequency of 16.6 pulses per second, with the plunger moving up to about 0.155 inch per pulse with 0.035 inch of that movement being free flight. As a result, the multiple changes to the interacting components of the '501 device resulting in the BioPulser 2 device, rather than merely providing a pulsating massage device, when properly applied to the skin 103, provides a drumming effect causing the muscle and surrounding membrane to vibrate at their tensioned resonant frequency, thus producing a moderate stimulation which soothes and relaxes the muscles while simultaneously avoiding over-stimulation which can cause them to contract. The BioPulser 2 is usable for Kanon hypertonic muscle correction protocols but can also be used alone as a "first-aid" device. As a complement to the BioPulser 2, compatible finger-tip "surfing" comprising manipulation of the muscle surface layers using a finger message techniques, (see FIG. 11) can also aid in stimulating without exciting the muscles.

The design parameters were determined by understanding the biological constraints of the neuro-muscular system. The nerve-bodies which communicate with the cerebellum to control muscle tone are located deep inside the muscles. Any attempt to apply an external stimulus directly to the nerve-bodies (called muscle spindles) will be blocked by a reflex contraction of the surrounding musculature.

This is further complicated by the irritability of the "sickened" overworking muscles. This irritability causes excessive reflex reactions so that the harder a muscle's hypertonic contraction, the more gently it must be approached. Once the hypertonic contraction has been reduced to the correct level, the muscle can sustain high levels of flexibility without reflex contraction so that the muscles provide the stimulus to the spindles that are within the muscle capsule.

Everybody suffers, knowingly or unknowingly, from varying degrees of excess muscle tone (hypertonicity). The tense state of the hypertonic muscles provides the opportunity to cause the muscles to vibrate, with the maximum vibration occurring at their tensioned resonant frequency. This good vibration then provides the desired stimulus. Merely oscillating the muscles is not beneficial; however they can be drummed using a snap percussive action.

Three factors control the amount of vibration produced by drumming: First, the greater the velocity at which the plunger strikes, the more the vibration. The BioPulser 2 uses a cam 114, such as shown in FIG. 9, to maximize velocity, said velocity limited due to biological constraints. The cam 114 in the BioPulser 2 maintains a velocity just below that which triggers pain reflex contraction (66.88 in/sec). Secondly, the more rapidly the repetition of the percussion, the more the vibration. The BioPulser 2 uses a timing belt 108 to control repetition rate which again, must be limited due to a biological constraints, The muscles are a complex reactive organism, not a simple passive structure; 16.6 repetitions per second has been found to be the preferred number that will not trigger reflex contraction. Thirdly, a minimal contact with the skin surface 103 reduces the amount of vibration damping.

Figure 7:
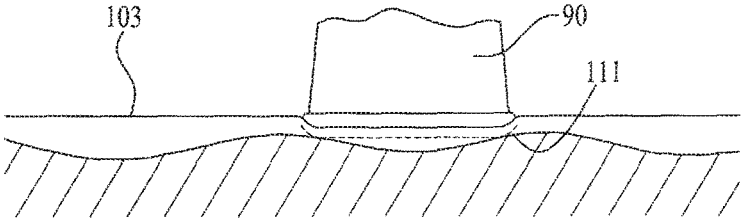
FIG. 7 is an illustration of an application to a skin surface of the device shown in FIG. 4.

The properly applied percussion "drums" the muscles into their tensioned resonant vibration within the constraints set forth above, therapeutically stimulating the muscle spindles buried among the muscle fibers in the optimum manner. Positioning the alternative applicator tip 90, 104 close to the skin surface 103 and the muscles below the skin surface, as shown in FIG. 7, allows the tip to sense the muscle 111 vibrations and transmit them into the BioPulser 2 case 102, which is lined with a felt vibration damper 126; the case 102 then acts as an acoustic chamber to amplify the sound. The muscle hum can be easily felt and heard over the light clicking percussion sound of the BioPulser 2.

The BioPulser 2 produces a sharp percussive motion-similar to a wrist snap in order to set the taut, overly contracted muscles into their resonant vibrations. The muscle vibration is the therapeutic stimulation, not the percussion.

FIG. 1 shows the BioPulser 2 100 comprising a two part assembled housing 102. The assembled housing 102 has a generally V-shaped integral handle support 16, with an apex 18 within the handle space. FIG. 11 shows a person using the device 100 which incorporates features of the invention in operative position drumming back muscles. A plug 20 is coupled via electric conduit 22 to a motor 105.

Figure 11:
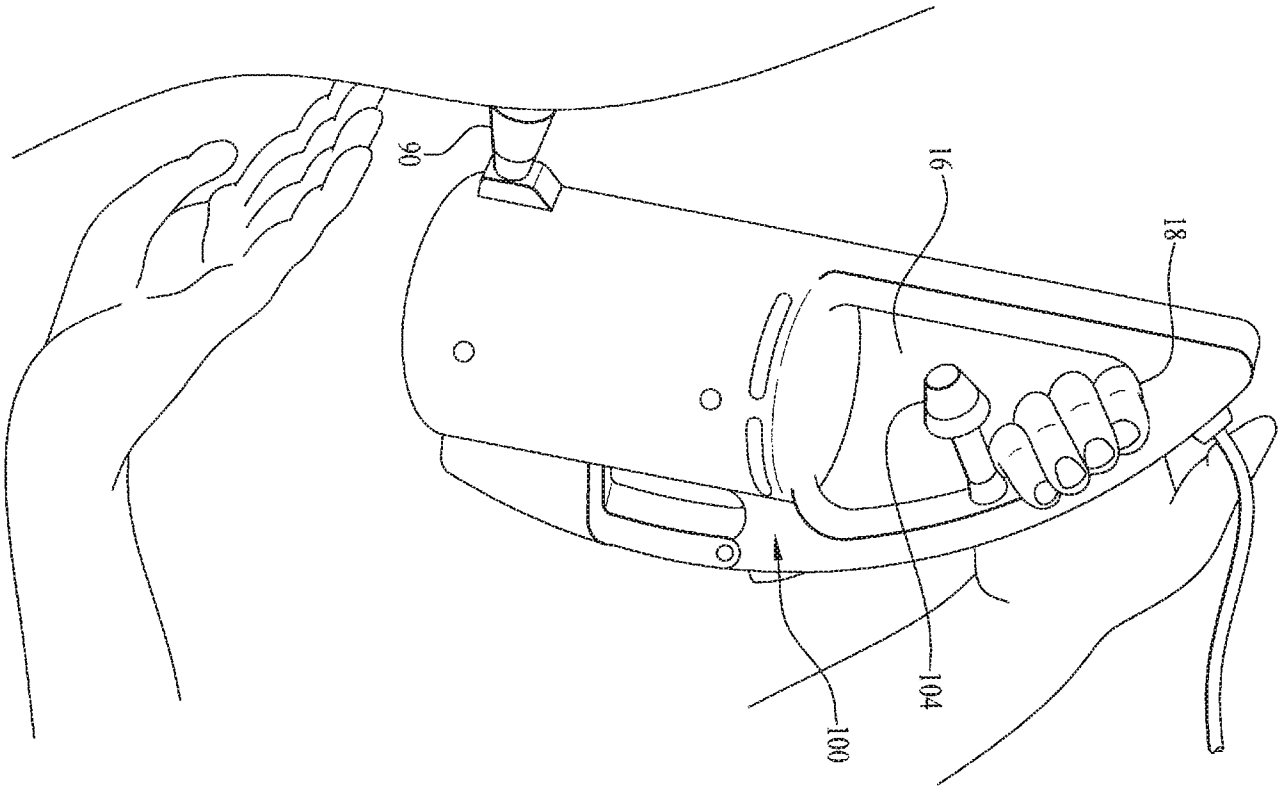
FIG. 11 shows the device of FIG. 1 properly held by an operator for application to a skin surface.

A properly position the BioPulser 2 is "dangled" by placing a thumb, or finger as shown in FIG. 11. Alternatively, a tripod handle as shown in FIG. 10 or, for self-treatment, a rod on a tripod positioned in the inside radius at the tail-end of the handle can be used. The force of gravity is now borne by the finger or rod in the handle so the applicator tip operates free of gravity.

A contracted muscle has multiple concentric layers of contracture with varying degrees of tautness in the layers between the surface and the core. The outer layers which are less taunt produce a lower pitch vibration which is felt as a fluttering sensation. The flutter of the muscle surface causes the applicator tip to deliver taps of varying intensity with each stroke. This in turn produces a series of dull sounding "down-beat" clicks with a lull in between. An individual can not readily hear all of the 16.6 strokes per second. However, the more taunt layers of muscle 111 in the core resonate at a higher pitch with a steady, grumbling, sometimes tickling tremor sensation and an audible hum at 16.6 cycles per second.

Irrespective of the inclusion of a single or double escapement in the device described above, to obtain the desired response from the underlying muscle and membrane it is important that the outer surface of the plunger tip 90, 104 be properly placed on the soft tissue overlying the muscle and membrane to be treated. If the tip is too far from the membrane, the tip will strike the auxiliary bumper before it reaches the membrane. If the tip is too close to the membrane, it will reduce or eliminate the free flight needed for escape. Because the muscle membrane to be acted upon is hidden under overlying tissues (see FIG. 7), properly placing the plunger necessitates developing a feel for the "sweet spots". An increase in the amplitude and smoothness of the membrane vibration provides an indication that the device is optimally positioned. The membrane vibration creates an audible hum and can be felt by the operator's finger tips lightly placed on the vibrating muscle, as shown in FIG. 11. This is accomplished by dangling, not gripping, the device by placing a finger (see FIG. 11) or a tripod handle 200 (see FIG. 10) under the inside radius or apex 18 at the rear end of the handle 16. This also separates the force needed to lift the unit from the very light force needed to make proper contact with the skin. Accordingly, while the components of the device are assembled in a manner so that the plunger action (length of extension, amount of free flight, frequency of pulses, etc.) are optimally provided, if the plunger during operation is not properly positioned adjacent the skin at a correct distance and with appropriate contact force the desired muscle and membrane response to the pulsating force delivery will not be obtained. Proper operation requires a synergistic combination of proper pulsating tip applied with a proper level of skin contact, which may, also be dependent on the area of the body being treated, and the depth of the muscle and membrane below the skin surface.

I claim:

1. A muscle drumming device configured to deliver a repetitive percussive strike to muscles below a skin surface, the device comprising:

a housing, a lower portion of the main housing enclosing:

a motor mounted in the housing and having or controlled to have a rotating shaft with a fixed rotational speed, a drive pulley mounted on the shaft, a driven pully having an integral triangularly shaped cam, a belt encircling the drive pulley and the driven pully, wherein the belt, the motor, the drive pully and the driven pully are altogether adapted to rotate the driven pulley at 16.6 cycles/sec, a plunger body mounted in the housing for reciprocal movement upon contact with the cam during each rotation of the driven pulley, and a plunger shaft mounted to the plunger body extending out of an opening in the housing, terminating in a resilient tip, and adapted to reciprocate and move laterally outward as a consequence of rotation of the driven pully the shaft rebounding off of a bumper.

2. The device of claim 1 wherein the lateral outward movement of the plunger shaft is 0.120 in.

3. The device of claim 2 wherein the plunger shaft is free to move laterally outward an additional 0.035 in.

4. The device of claim 1 wherein the plunger shaft moves in a rapid, linear motion and cycles 16.6 times per second.

5. The device of claim 1 wherein the lateral movement of the plunger shaft is restricted by the housing.

6. The device claim 1 wherein the housing includes an upper portion having a support handle integral therewith for suspending and positioning the device.

7. The device of claim 1 wherein the motor is a 3000 RPM slip-sync drive motor.

8. The device of claim 1 wherein the belt is toothed, the drive pulley has 10 teeth, the driven pulley has 30 teeth and the belt has 35 teeth.

9. The device of claim 1 wherein the plunger body is mounted within the housing by a bracket mounted to the motor, and a pair of spaced pivotally mounted links interconnect the bracket to the plunger body to provide lateral movement.

10. The device of claim 1 configured, when positioned for skin contact, so that the plunger shaft delivers repetitive reciprocating tapping to the skin surface sufficient to consistently place muscles below the skin surface in resonant vibration.

* * * * *